United States Patent [19]

De Spain et al.

[11] Patent Number: 4,586,293

[45] Date of Patent: May 6, 1986

[54] METHOD AND APPARATUS FOR SURFACE TREATING A WORKPIECE

[75] Inventors: James R. De Spain, Prospect; Michael W. Burke, Louisville, both of Ky.

[73] Assignee: Carrier Vibrating Equipment, Inc., Louisville, Ky.

[21] Appl. No.: 604,926

[22] Filed: Apr. 27, 1984

[51] Int. Cl.[4] ..... B24B 19/00

[52] U.S. Cl. ..... 51/7; 51/16; 51/17; 51/163.1

[58] Field of Search ..... 51/7, 163.1, 16, 17

[56] References Cited

U.S. PATENT DOCUMENTS

| | | | |
|---|---|---|---|
| 830,349 | 9/1906 | Meurer | 51/7 |
| 3,336,701 | 8/1967 | Moore | 51/7 |
| 4,025,419 | 5/1977 | Musschoot | 51/163.1 |

FOREIGN PATENT DOCUMENTS

| | | | |
|---|---|---|---|
| 540726 | 1/1977 | U.S.S.R. | 51/7 |
| 580094 | 11/1977 | U.S.S.R. | 51/7 |
| 872215 | 10/1981 | U.S.S.R. | 51/163.1 |
| 935256 | 6/1982 | U.S.S.R. | 51/163.1 |
| 1007940 | 3/1983 | U.S.S.R. | 51/7 |

*Primary Examiner*—Frederick R. Schmidt
*Assistant Examiner*—J. T. Zatarga
*Attorney, Agent, or Firm*—Jon C. Winger

[57] ABSTRACT

A method for surface treating a continuous flow of workpieces includes the steps of fluidizing a stationary bed of surface treating media, aggitating the fluidized bed of surface treating to create a scrubbing action to the surface treating media, and moving the workpieces to be treated through the stationary, fluidized aggitated media bed subjecting the workpieces to the scrubbing action of the media. Further, an apparatus for surface treating workpieces which includes a trough for containing a bed or pool of surface treating media, a force vibration generating device for imparting a reciprocating force, having at least a vertical force vector, to the trough and, therefore, to the surface treating media contained in the trough, and a means of conveying the workpieces to be treated continuously through the trough and, therefore, through the media.

14 Claims, 4 Drawing Figures

METHOD AND APPARATUS FOR SURFACE TREATING A WORKPIECE

BACKGROUND OF THE INVENTION

1. Field of the Invention

The present invention relates to a method and apparatus for surface treating the surfaces of a workpiece, more particularly, to a method and apparatus wherein the workpieces to be surface treated are continuously moved through a bed of aggitated surface treating media.

2. Discussion of the Prior Art

Various processes and apparatus are known to the art for surface treating workpieces. Examples are shown in the following U.S. patents.

U.S. Pat. No. 2,815,609 issued on Dec. 20, 1957 shows an apparatus for deburring and polishing workpieces including a pan which holds deburring material such as steel balls or stones. The pan is mounted in a stationary frame for vertical reciprocating movement by means of sprockets and chains supported on the frame. The apparatus includes a shaft which is mounted to the frame over the pan and is moved in a reciprocating motion along its longitudinal axis by means of an eccentric. The workpiece to be deburred is clamped to the reciprocating shaft to depend therefrom, and the pan is raised so that the workpiece is submerged in the deburring material. The shaft is then reciprocated to move the workpiece back and forth through the deburring material. After a sufficient time, the pan is lowered and the workpiece is removed from the deburring material, and the deburred workpiece is removed from the shaft.

U.S. Patent No. 2,918,926 issued on Dec. 29, 1959 shows a washing and degreasing apparatus which includes a large tank for holding a suitable liquid cleaning solution. A parts basket having perforated walls is suspended into the liquid solution in the tank. The parts basket has one open end, and is mounted on springs for vibrator and oscillatory motion. A vibration generating device which includes an electric motor is connected to the parts basket by means of a belt to impart a vibratory motion to the basket. In addition, a sloped endless conveyor is located within the tank so that a portion of the conveyor lies below the open end of the parts basket to receive the parts from the basket and convey the parts out of the tank. Parts to be cleaned are deposited in the basket near the end thereof opposite the open basket end so that they are immersed in the cleaning solution. The basket is then caused to vibrate so that the parts therein will be moved toward the open basket end and be discharged onto the endless conveyor for removal from the tank.

U.S. Pat. No. 3,045,397 issued on July 24, 1962 shows an apparatus for surface treating parts which includes a support frame mounted on springs and an electric motor connected to the support frame through a belt system for imparting a vibratory action to the support frame. The apparatus further includes a plurality of parts receiving vats rigidly mounted to the support frame. The parts to be treated as well as liquid treating agent are placed in the vats, and the frame is vibrated.

U.S. Pat. No. 3,128,577 issued on April 14, 1964 shows an apparatus for deburring articles of considerable length which includes a tank containing abrasive material. Vibrator devices are attached to the outer side of the floor of the tank to vibrate the abrasive material in the tank. The opposite end walls of the tank have aligned apertures for accommodating the longitudinal movement of an elongated article to be deburred through the tank. The apertures have seals to prevent abrasive material from leaking out of the tank. Powered, article feed rollers are located outside the tank at one end wall. The elongated article to be deburred is inserted longitudinally through the apertures in the tank end walls and is engaged by the feed rollers. The feed rollers move the elongated article through the tank wherein it is subjected to the vibrating abrasive material and is deburred thereby.

U.S. Pat. No. 3,148,483 issued on Sept. 15, 1964 shows a machine for the surface treatment of an article by the reaction of media in vibratory movement which includes a rigid base with a horizontal table resiliently supported on the base by coil springs and a trough containing particulate treating material is secured to the table. Vibratory movement is imparted to the table, and therefore to the trough, by means of an eccentric drive arrangement located in the base below the table. The elongated trough has an upstream end wall, spaced apart side walls, a concave floor, and is open at the downstream end. A perforated platform is located at the open downstream or outlet end of the trough to separate particulate media exiting the trough from the treated articles also exiting the trough. The separated media is returned to the upstream end of the trough through an inlet chute for reuse in the treatment of further articles placed in the trough.

U.S. Pat. No. 3,336,701 issued on Aug. 22, 1967 shows a vibratory finishing apparatus for deburring articles including an elongated, downwardly inclined container box containing an abrasive particulate material. The elongated, sloped container box is suspended on air cushions on fixed legs. Vibration is imparted to the container box by means of driven shafts and eccentric weights located beneath the container box. Articles to be finished are loaded into the container box by a chute located at the elevated container end. The lower end of the container box includes a lip over which finished articles and particulate treating material overflow from the container box. A screen arrangement is positioned beneath the container lip outside the container box for separating finished articles from the abrasive particulate material. The particulate material passes through the screen onto a recycling conveyor which returns toe particulate material back to the container box for reuse.

U.S. Pat. No. 4,258,505 issued on May 31, 1981 shows another apparatus for cleaning a workpiece with abrasive particulate material which includes a closed vessel. A grate is located within the vessel above the vessel floor. A bed of abrasive material is located above and supported on the grate, and the volume beneath the grate forms a plenum chamber. Compressed air is introduces into the plenum chamber and passes upwardly through the grate to maintain the abrasive material in a fluid and agitated state. The two end walls o the vessel are formed with openings through which a continuous elongated workpiece is moved through the bed of abrasive material. In addition, air conduits are located through the bed of abrasive material next to the path of the elongated workpiece passing through the abrasive material bed. These air conduits have nozzles oriented to direct compressed air streams against the surface of the workpiece moving through the abrasive material bed. The air issuing from these nozzles pick up particles from the fluidized bed and propels the abrasive particles at high velocity against the surface of the workpiece. A mixture of air and abrasive material rising from the abrasive bed is removed from the vessel through an exhaust duct to a separator device. The separator device separates particulate material from the air. The separated particulate material is returned to the vessel for reuse, and the separated air is exhausted to the atmosphere.

SUMMARY OF THE INVENTION

The present invention provides a method and an apparatus for the continuous surface treating of workpieces.

The present invention further provides a method and apparatus for the continuous surface treating of workpieces which are intermixed of workpieces of various different sizes and shapes without any modification to the method or apparatus.

The present invention further provides a method and apparatus of the class described wherein the exterior surface and any open internal voids of the workpiece are concurrently surface treated.

More particular, the present invention in one embodiment provides a method of surface treating workpieces comprising the steps of: fluidizing a substantially stationarily positioned bed of a surface treating media; aggitating the fluidized bed of surface treating media; and, submerging the workpiece in the fluidized, aggitated bed of surface treating media while concurrently continuously conveying the workpiece through the surface treating media bed from one end to the other end thereof.

The present invention further provides an apparatus for surface treating workpieces, comprising: means defining a reservoir for containing a bed of surface treatment media; vibrating means for imparting a vibratory force to the reservoir defining means; and, means for passing a gas generally upwardly through the reservoir defining means to fluidize the bed of surface treatment media contained therein.

BRIEF DESCRIPTION OF THE DRAWINGS

The various features and advantages of the present invention will become even more clear upon reference to the following discussion in conjunction with the accompanying drawings wherein like numerals refer to like parts through and in which.

DETAILED DESCRIPTION OF THE PREFERRED EMBODIMENT

Figure 1:
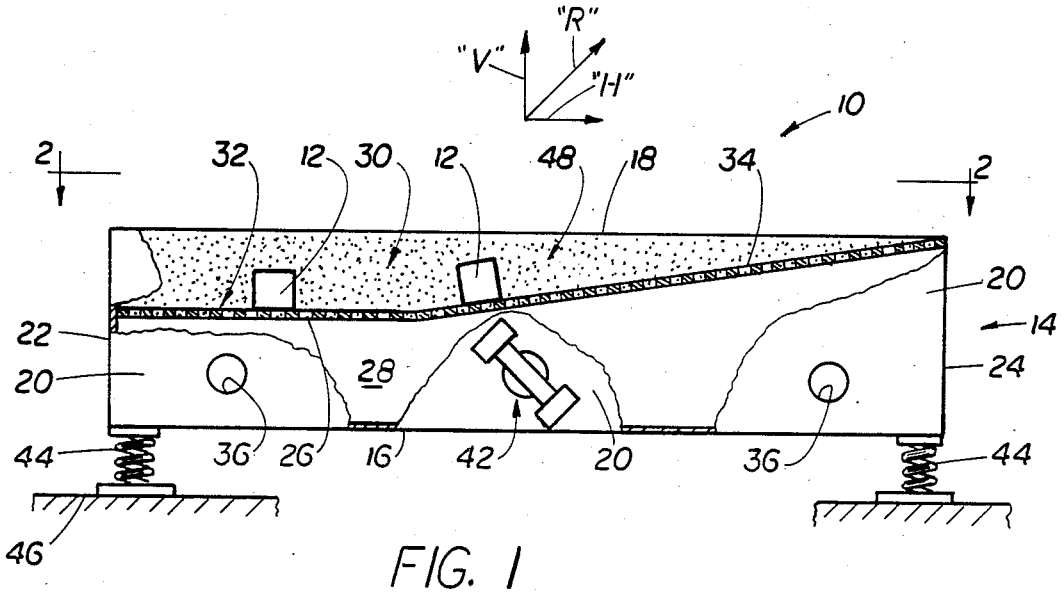
FIG. 1 is a side view of one advantageous embodiment of the present invention with portions broken out to more clearly show internal features.
Figure 2:
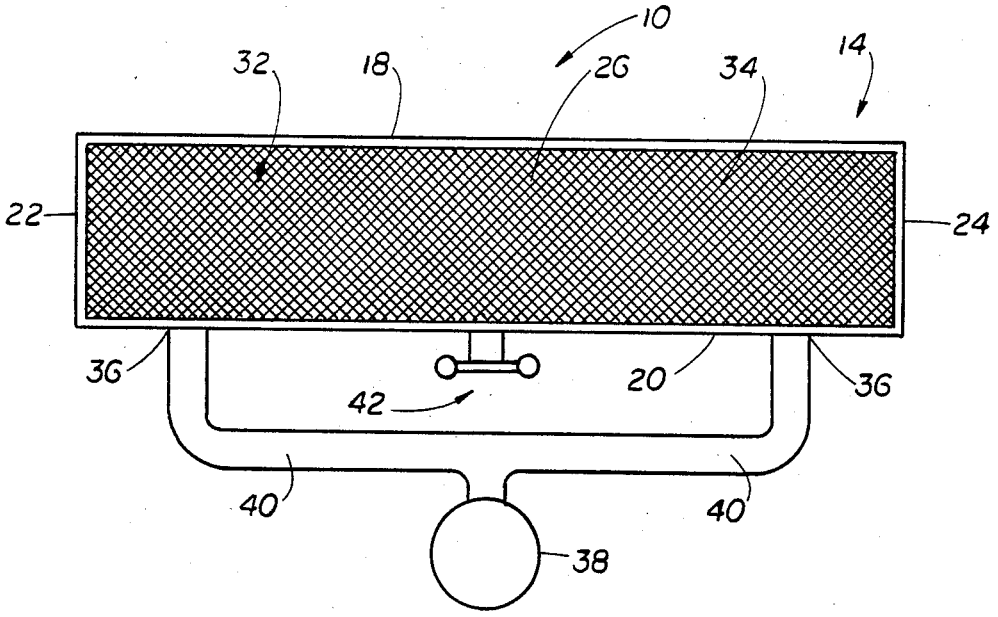
FIG. 2 is a top view of FIG. 1 as viewed in the direction of arrows 2—2 in FIG. 1.

With reference to FIGS. 1 and 2, there is shown a longitudinal cross-sectional view of an apparatus of the present invention, generally denoted as the numeral 10, for surface treating workpieces 12. The workpieces to be surface treated can be virtually any article of manufacture. Examples of the types of surface treatment for which the apparatus 10 can be used include, but are not limited to, deburring, polishing, burnishing and cleaning of the workpieces.

The apparatus 10 includes an elongated housing, generally denoted as the numeral 14, which comprises a floor 16, two spaced apart generally parallel side walls 18 and 20, and two spaced apart generally parallel end walls 22 and 24. In addition, an elongated foraminous top deck 26 coextensive with the length and width of the housing 10 is located in the housing below the top edges of the housing walls 18, 20, 22, 24 and above the housing floor 16. The foraminous deck 26 cooperates with the housing floor 16 and the portion of the housing walls below the deck 26 to define a fluidizing gas plenum 28. Further, the foraminous deck 26 cooperates with the portion of the housing walls above the deck 26 to define a surface treatment media reservoir 30. As can be best seen in FIG. 1, the foraminous deck 26 includes a generally horizontal upstream length 32 which is located a substantial distance below the top edges of the housing walls, and an upwardly inclined downstream length 34. The horizontal deck length 32 extends from the upstream housing end wall 22 longitudinally of the housing 10 in a direction toward the downstream housing end wall 24 and terminates at a predetermined location short of the downstream housing end wall 24. The upwardly inclined deck length 34 mates with the terminal end of the horizontal deck length 32 and extends upwardly therefrom to substantially the top edge of the downstream housing end wall 24. The horizontal deck length 32 is preferably located below the top edges of the housing walls by a distance at least equal to the largest dimension of the workpiece 12 to be surface treated. The length of the horizontal deck length 32 will be determined by the length of time required to complete the surface treatment of the workpiece. The housing 14 also includes fluidizing gas inlet ports 36 formed through a housing side wall, for example side wall 20, to communicate with the plenum 28. Fluidizing gas can be introduced through the gas inlet ports 36 by virtually any means, for example as illustrated in FIGS. 1 and 2, by a fan or blower 38 which forces air through appropriate conduits 40 interconnecting the blower 38 to the inlet ports 36.

The apparatus 10 further includes vibrating means, generally denoted as the numeral 42, for causing the housing 14 to vibrate. The vibrating means can be virtually any known or otherwise convenient device such as, for example, an eccentric drive arrangement or rotating unbalanced mass device. The critical feature of the vibrating means 42, of whatever type used, is that is imparts to the housing 14 a horizontal component vector (denoted by the arrow "H" in FIG. 1) in the direction generally from the upstream housing end wall 22 toward the downstream housing end wall 24, and a generally vertical component vector (denoted by the arrow "V" in FIG. 1). That is to say, the resultant of the vibration vector imparted to the housing should be at an acute angle to the horizontal (denoted by the arrow "R" in FIG. 1).

The housing 14 is preferably mounted on vibration isolation damper means 44 to isolate the vibrating apparatus 10 from its environment. Various isolation damper means are well known and include, but are not limited to gas filled bags, liquid filled devices, resilient pads and leaf springs. As shown in FIG. 1, the apparatus 10 is isolated from the floor 46 of a facility in which it is placed by vibration dampers in the form of coil springs.

The surface treating media reservoir 30 is filled with an appropriate workpiece surface treating media 48. It is presently contemplated that the surface treating media 48 will be particulate material, or a combination of particulate material and liquid. The exact nature of the surface treating media will, of course, depend upon the type of surface treatment to be carried out, and upon the material of which the workpieces 12 are fabricated. However, by way of example, the particulate material could be sand, stones, steel shot, and the liquid could be, for example, a solvent such as water.

Figure 3:
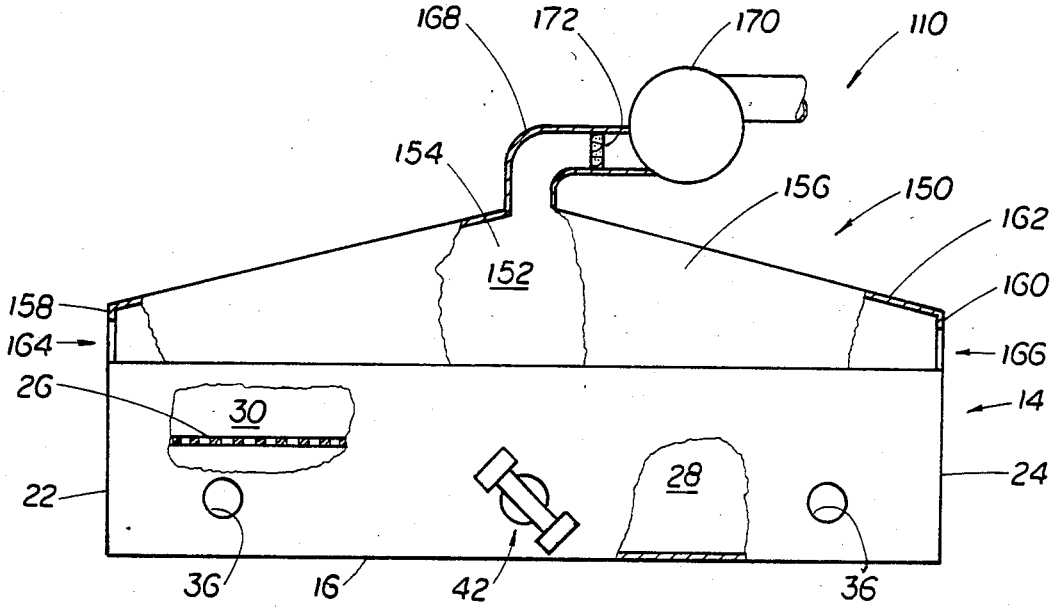
FIG. 3 is a side view of another advantageous embodiment of the present invention with portions broken away to more clearly show internal features; and, FIG. 4 is a side view of a further advantageous embodiment of the present invention with portions broken away to more clearly show internal features.

FIG. 3 illustrates another advantageous embodiment of the present invention, denoted generally as the numeral 110, which is identical to the embodiment of FIGS. 1 and 2 in virtually every respect except for the way that fluidizing gas is introduced into the plenum 28. Therefore, the description of, and numerals denoting the various features and components of the apparatus 10 of FIGS. 1 and 2, apply to the common features and components of the apparatus 110 of FIG. 3.

With reference to FIG. 3, the apparatus 110 includes a hood structure 150 over the top of the housing 14 and cooperating with the housing walls 18, 20, 22 and 24 to define a low pressure chamber 152 over the top of the foraminous deck 26. As shown, the hood structure 150 includes two, parallel, spaced apart side walls 154 and 156 which are coextensive with and extend upwardly from the top edge of the housing side walls 18 and 20, respectively, and two, parallel, spaced apart end walls 158 and 160 which are coextensive with and extend upwardly from the top edge of the housing end walls 22 and 24, respectively. The hood structure 150 further includes a roof 162 which slopes upwardly from the hood walls 154, 156, 158, 160 converging toward an apex. The hood upstream end wall 158 extending upwardly from the housing end wall 22 is formed with an opening 164 through which workpieces 12 to be surface treated enter the surface treatment media reservoir 30, and an opening 166 through with the surface treated workpiece 12 leaves the surface treatment media reservoir 30. An exhaust duct 168 located at the apex of the hood structure and is open to the low pressure chamber 152. Low pressure creating means 170 such as, for example, a suction fan or blower 170 is operatively with the exhaust duct 168 to remove air from the low pressure chamber 152. Further, gas separation means 172 is located within the exhaust duct 168 to remove particulate matter from the exhaust gas stream. The gas separation means 162 can be of virtually any type.

The operation of the apparatus 10 of FIGS. 1 and 2, and the apparatus 110 of FIG. 3 are essentially identical. The air flow from the fluidizing gas plenum 28 flows upwardly from the plenum 28, through the foraminous deck 26 and through the bed of surface treating media 48 in the surface treating media reservoir 30, thus, fluidizing the treating media 48. The vibration imparted to the deck 26, in addition to imparting a vibratory motion scrubbing-like motion to the treating media 48, the horizontal force component functions as a motive force to move the workpieces 12 along the deck 26 through the bed of treating media 48 from the upstream end of the deck 26 and up the inclined deck length 34 to the upstream end of the deck 26 whereupon the workpiece exits the apparatus. Thus, the workpiece 12 is substantially submerged in the bed of treating media 48 as it moves along the horizontal upstream deck length 32 and gradually emerges from the bed of surface treating media 48 as it climbs the inclined deck length portion 34.

In the apparatus 10 if FIGS. 1 and 2, the fan 38 pressurizes the fluidizing gas plenum 26, thus, forcing fluidizing gas upwardly through the foraminous deck 26.

In the apparatus 110 of FIG. 3, the suction fan 170 causes the creation of a low pressure in the low pressure chamber 152 of the hood structure 150, thus, causing air to flow through the gas inlet ports 36 in the housing side wall 20 and into the fluidizing gas plenum 28. The fluidizing gas flows upwardly through the foraminous deck 26 fluidizing the bed of treating media 48 and into the low pressure chamber 152. The fluidizing gas flows out of the low pressure chamber 152 through the exhaust duct 168. Any particulate matter entrained in the exhaust fluidizing gas is separated from the gas by the gas separation means 172 before it leaves the apparatus.

Figure 4:
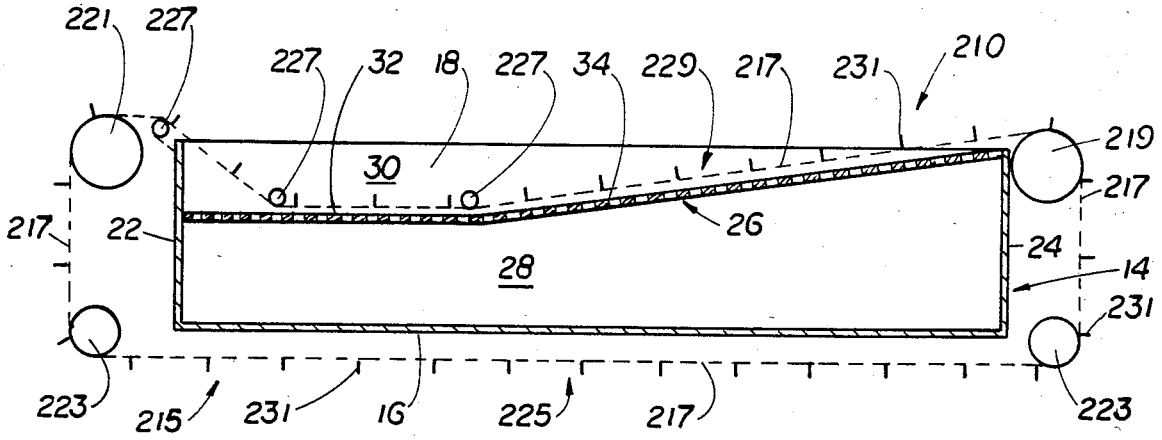

FIG. 4 illustrates yet another advantageous apparatus of the present invention, generally denoted by the numeral 210. The apparatus 210 has many features and components in common with the apparatus 10 of FIGS. 1 and 2, and with the apparatus 110 of FIG. 3. These common features are denoted in FIG. 4 by the identical numerals used in FIGS. 1, 2 and 3, and for the sake of brevity they will not be discussed again. The essential difference between the apparatus 210 and the apparatuses 10 and 110 is that the apparatus 210 further comprises a conveyor device, generally denoted as the numeral 215, to move the workpieces 12 through the bed of treating media 48 in the surface treating reservoir 28. As shown, the workpiece conveyor device 215 comprises an endless conveyor apparatus having a foraminous endless belt 217 trained about a driven head pulley 219 located outside the housing 14 at the downstream housing end wall 24, and a tail pulley 221 located outside the housing 14 at the upstream housing end wall 22. Idler pulleys 223 are appropriately located to position the lower belt flight 225 to clear the housing 14. In addition, belt tensioning or guide pulleys 227 are selectively located in the treatment media reservoir 30 to guide the top flight 229 of the belt 217 along a path over the top surface of the deck 26 generally corresponding to the configuration of the deck 26. The conveyor belt 217 may also include upwardly projecting workpiece engagement cleats 231 for positively engaging workpieces 12 to be transported on the conveyor belt top flight 229 through the surface treatment media reservoir 30. With the inclusion of the conveyor device 215, the vibrating means 42 need not necessarily impart a horizontal force vector to the deck 26, but only a vertical force vector to impart a scrubbing-like vibratory motion to the treatment media 48 in the surface treatment media reservoir 30. The portion of the top conveyor belt flight 229 over the horizontal deck length 32 should be located a sufficient distance below the top surface of the bed of treating media 48 to provide for the substantial immersion of the workpieces in the bed of treating media 48.

The apparatus and method of the present invention provides for the continuously flow of workpieces through the surface treatment reservoir, and for the intermixing of workpieces of different sizes and shapes through the service treatment reservoir without any modification. Further, because the workpieces to be surface treated are substantially submerged in vibrating surface treating media, the exterior surface of the workpiece as well as any open internal ports, passageways, chambers and the like, formed in the workpiece are subjected to the treating process.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A method of surface treating a workpiece comprising the steps of:

continuously passing a gas upwardly through a substantially stationarily positioned horizontally oriented, elongated bed of a surface media contained in an elongated horizontally oriented reservoir to fluidize the bed;

continuously imparting a substantially vertical vibratory force to the bed of surface treating media to further fluidize the bed and aggitate the bed of surface treating media;

submerging the workpiece in the fluidized, aggitated bed of surface treating media at one end of the reservoir; and imparting a generally horizontal vibratory force to the reservoir for conveying the workpiece in a substantially linear direction through the bed of surface treating media from the entrance end of the reservoir to the exit end of the reservoir opposite the entrance end.

2. The method of claim 1, wherein the step of conveying the workpiece through the bed of surface treating media comprises conveying the workpiece in a substantially horizontal plane toward the exit end of the reservoir and then up an inclined plane to the exit end of the reservoir.

3. The method of claim 1, further comprising separating the gas from any entrained particulate material after the gas has passed through the bed of surface treating media.

4. The method of claim 1, wherein the step of conveying the workpieces through the bed of surface treating media comprises carrying the workpieces on the top flight of a conveyor device.

5. An apparatus for surface treating workpieces comprising: means defining an elongated, substantially horizontal reservoir having an working entrance at one end and a workpiece exit at the opposite end for containing a bed of surface treatment media;

vibrating means for imparting a vibratory force to the reservoir defining means having at generally horizontal force vector in a direction from the workpiece entrance end to the workpiece exit end thereby causing the workpiece to be conveyed through the reservoir in the direction of the horizontal force vector, and a generally vertical force vector in a direction upwardly of the reservoir to aggitate the workpiece within the bed of surface treatment media; and, means for passing a gas generally upwardly through the reservoir defining means to fluidize the bed of surface treatment media contained therein.

6. The apparatus of claim 5, further comprising:

means defining a fluidizing gas plenum below the reservoir defining means; and, means for creating a gas pressure in the gas plenum chamber higher than the gas pressure over the top of the reservoir defining means.

7. The apparatus of claim 5, further comprising means for conveying workpieces through the bed of treating media contained in the reservoir defining means.

8. The apparatus of claim 7, wherein the workpiece conveying means comprises a foraminous endless conveyor belt having its upper flight extending through the reservoir defining means.

9. The apparatus of claim 5, further comprising:

means defining a low pressure gas chamber over the reservoir defining means; and, means for creating a low pressure within the low pressure gas chamber defining means.

10. An apparatus for surface treating workpieces, comprising:

an elongated housing having a floor, spaced apart generally parallel side walls, and spaced apart generally parallel end walls, one end wall defining the entrance end of the apparatus and the opposite end wall defining the exit end of the apparatus for workpieces moving through the apparatus;

a foraminous deck located within the housing below the top edges of the housing walls, the foraminous deck having a horizontal upstream length extending generally from the housing end wall at the entrance end of the housing toward the housing end wall at the exit end of the housing and terminating at a predetermined location short of the housing end wall at the exit of the housing, the horizontal upstream deck length being located a sufficient distance below the top edges of the housing walls so that the depth of the bed of treating media above the horizontal deck length is at least as deep as the largest dimension of the articles to be surface treated, and an upwardly inclined deck length extending from the terminating edge of the horizontal deck length to a location proximate the housing end wall at the exit end of the housing:

a surface treating media reservoir for containing a bed of surface treating media defined by the foraminous deck and portions of the housing walls above the foraminous deck;

a fluidizing gas plenum defined by the foraminous deck and portions of the housing walls below the foraminous deck; and, vibrating means for imparting a vibratory force to the housing having a generally horizontal force vector in a direction from the housing end wall at the entrance end of the housing toward the housing end wall at the exit end of the housing for continuously conveying the workpiece through the reservoir in a substantially linear direction from the housing inlet end to the housing outlet end, and a generally vertical component in an upward direction of the housing to aggitate workpieces as they are being conveyed in the housing.

11. The apparatus of claim 10, further comprising means for creating a gas pressure in the fluidizing gas plenum higher than the gas pressure above the surface media treating reservoir.

12. The apparatus of claim 11, wherein the gas pressure creating means comprises means for pressurizing the fluidizing gas plenum.

13. The apparatus of claim 11, wherein the gas pressure creating means comprises:

means defining a low pressure chamber over the surface media treating means; and, means for evacuating gas from the low pressure chamber defining means.

14. The apparatus of claim 10, further comprising conveyor means for conveying the workpieces to be treated through the apparatus having an endless foraminous endless belt with the top flight of the foraminous endless belt extending over the foraminous deck from one housing end wall to the other housing end wall.

* * * * *